US010112409B2

(12) United States Patent
Hoshii

(10) Patent No.: US 10,112,409 B2
(45) Date of Patent: Oct. 30, 2018

(54) IMAGE FORMING APPARATUS AND IMAGE FORMING METHOD

(71) Applicant: SEIKO EPSON CORPORATION, Tokyo (JP)

(72) Inventor: Jun Hoshii, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/509,671

(22) PCT Filed: Sep. 14, 2015

(86) PCT No.: PCT/JP2015/004669
§ 371 (c)(1),
(2) Date: Mar. 8, 2017

(87) PCT Pub. No.: WO2016/042752
PCT Pub. Date: Mar. 24, 2016

(65) Prior Publication Data

US 2017/0259597 A1 Sep. 14, 2017

(30) Foreign Application Priority Data

Sep. 18, 2014 (JP) ..... 2014-189733

(51) Int. Cl.
*B41J 2/21* (2006.01)
*B41J 2/135* (2006.01)
(Continued)

(52) U.S. Cl.
CPC ..... *B41J 2/2132* (2013.01); *B41J 2/04503* (2013.01); *B41J 2/135* (2013.01); *B41J 2/5056* (2013.01)

(58) Field of Classification Search
CPC .... B41J 2/2132; B41J 2/5056; B41J 2/04503; B41J 2/135
See application file for complete search history.

(56) References Cited

U.S. PATENT DOCUMENTS 6,203,134 B1 3/2001 Kakutani et al.
6,439,677 B1 8/2002 Kanaya et al.
(Continued)

FOREIGN PATENT DOCUMENTS

JP 2004-195991 A 7/2004
JP 2010-017976 * 1/2010 ..... B41J 2/01
(Continued)

*Primary Examiner* — Geoffrey Mruk
(74) *Attorney, Agent, or Firm* — Harness, Dickey & Pierce, P.L.C.

(57) ABSTRACT

In an image forming apparatus (an ink jet printer 100), in a sub scanning direction, when an area in arrange of a nozzle at an end portion of a head (41) to a nozzle at a predetermined distance is set as a predetermined area, and a medium is transported in a certain amount by using the head (41), a scan portion, and a transport portion so as to form an image on medium sheet (10), the number of times of scanning for forming a dot array which is formed by using the nozzles included in the predetermined area is more than the number of times of the scanning for forming a dot array which does not use the nozzle in the predetermined area, and the number of times of the scanning for forming the dot array by using the nozzles included in the predetermined area is at least three times.

4 Claims, 11 Drawing Sheets

[Fig. 5]

(51) Int. Cl.
*B41J 2/505* (2006.01)
*B41J 2/045* (2006.01)

(56) References Cited

U.S. PATENT DOCUMENTS

| | | | |
|---|---|---|---|
| 2010/0245446 | A1 | 9/2010 | Nishikori et al. |
| 2010/0271414 | A1 | 10/2010 | Kaizu et al. |
| 2012/0200633 | A1 | 8/2012 | Aoyama |

FOREIGN PATENT DOCUMENTS

| | | | |
|---|---|---|---|
| JP | 2010-017976 | A | 1/2010 |
| JP | 2010-253841 | A | 11/2010 |

* cited by examiner

[Fig. 1A]
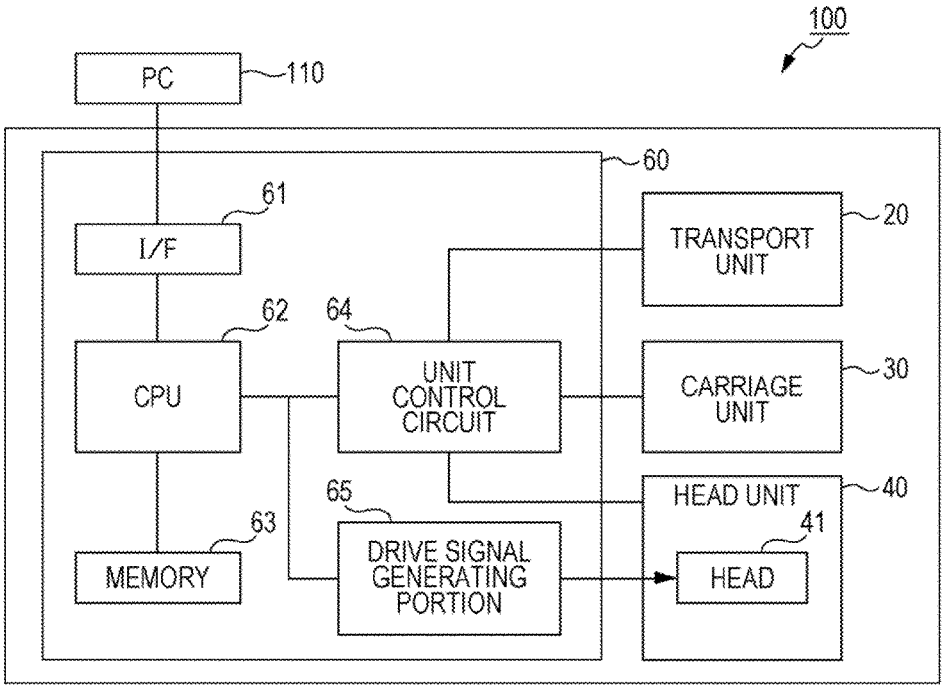
[Fig. 1B]
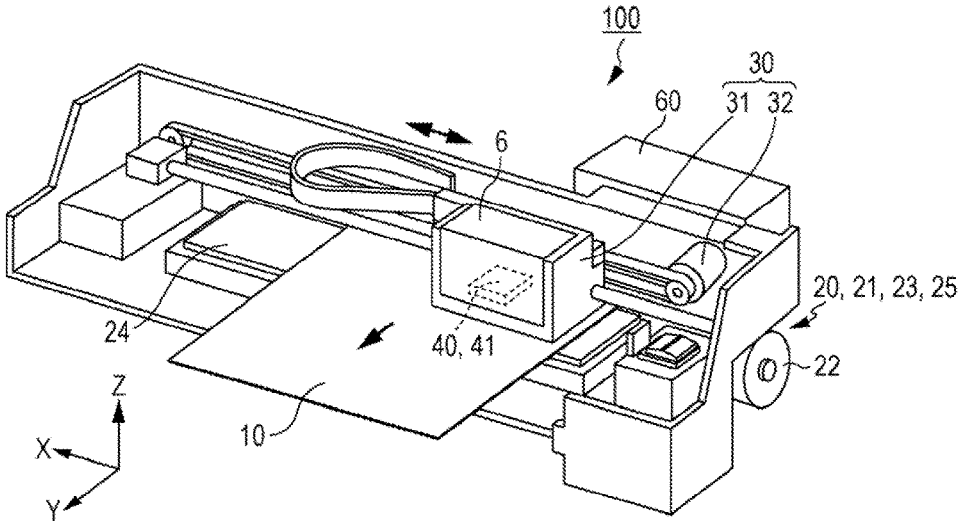

[Fig. 2]
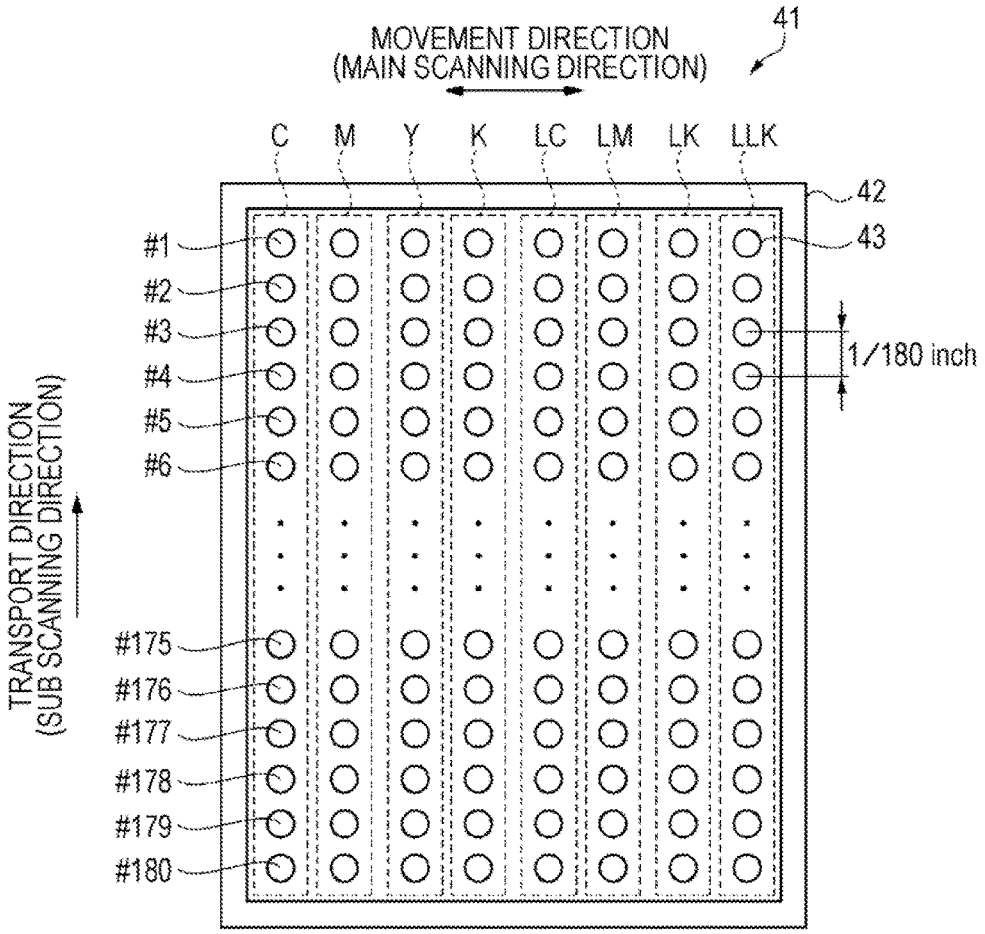

[Fig. 3]
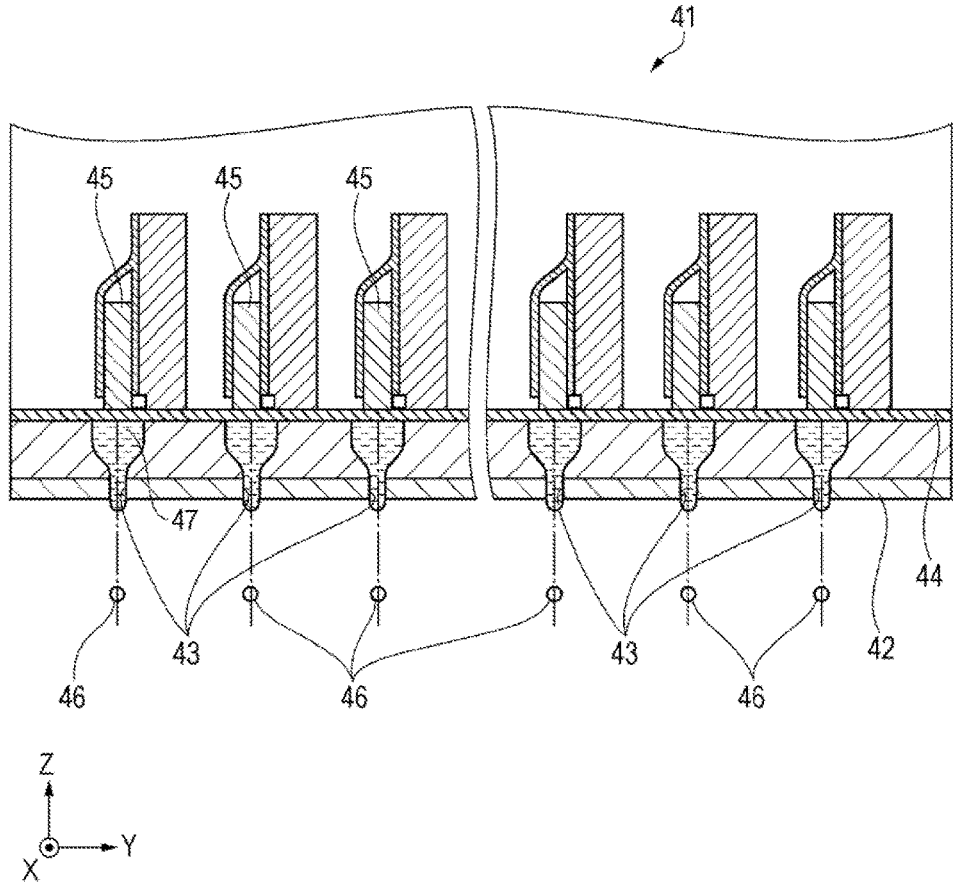

[Fig. 4A]
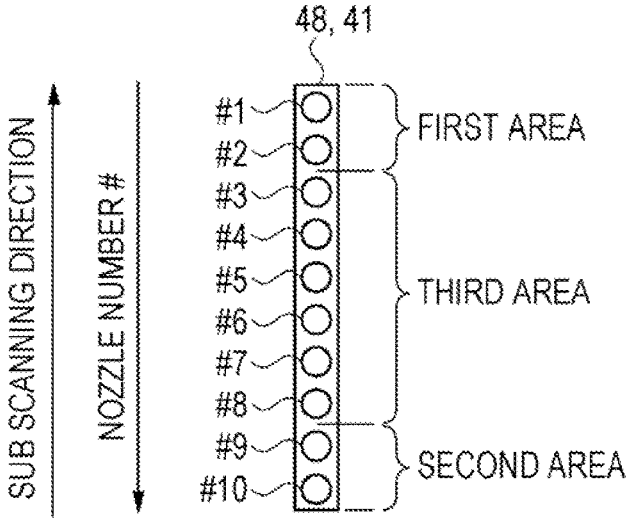
[Fig. 4B]
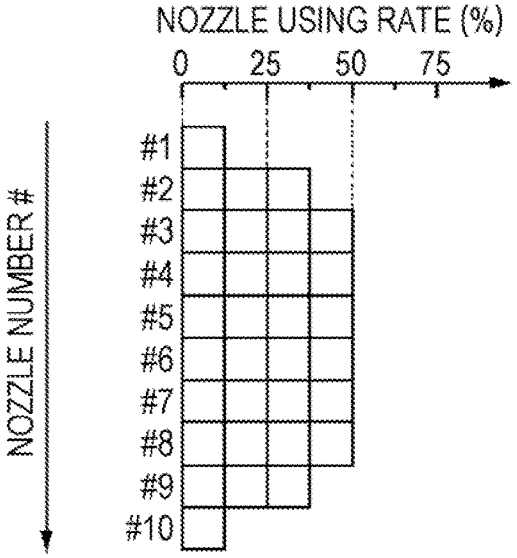

[Fig. 5]
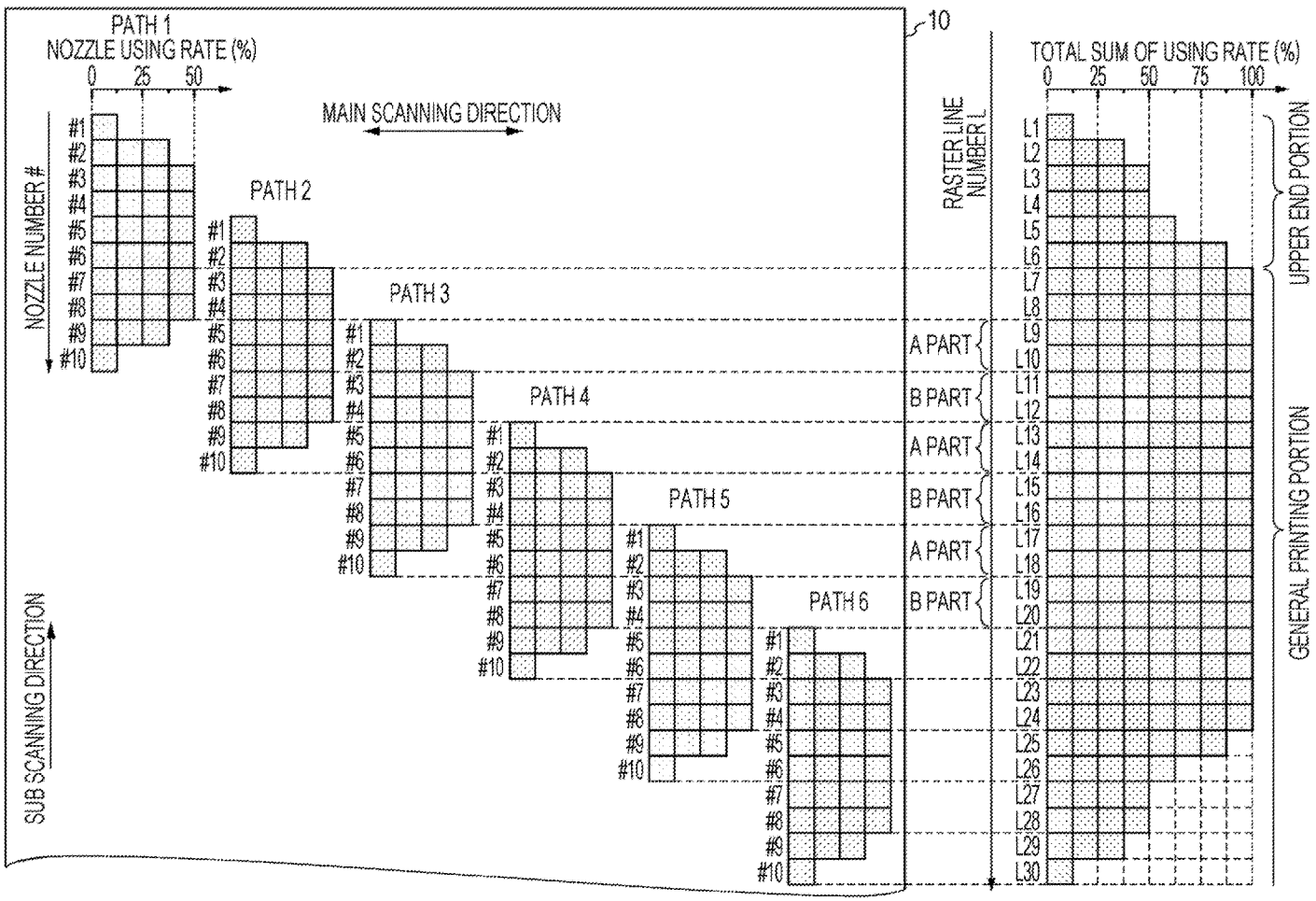

[Fig. 6A]
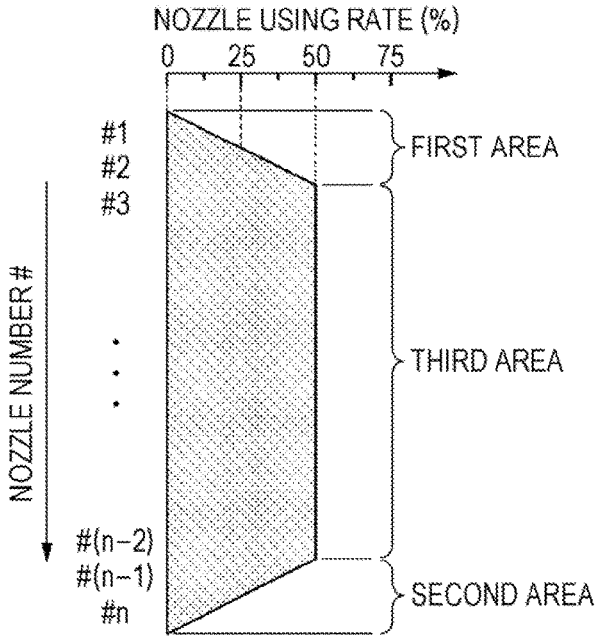
[Fig. 6B]
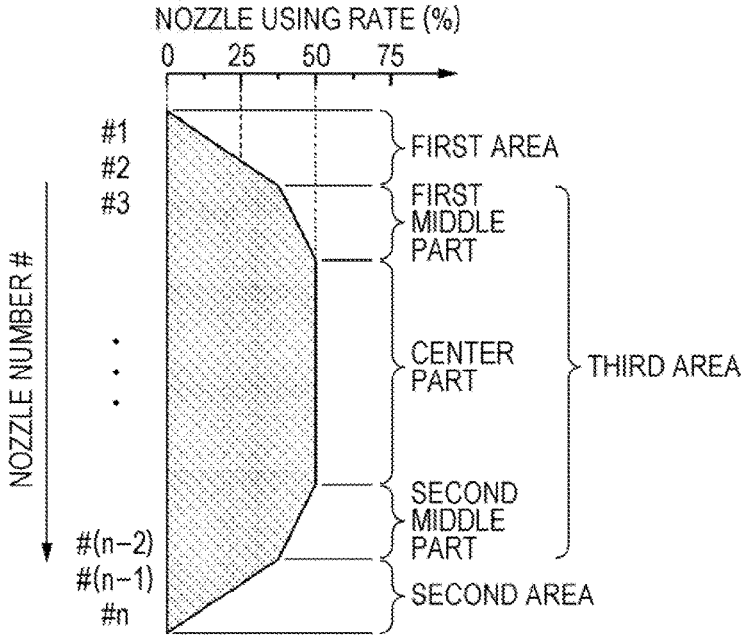

[Fig. 7]
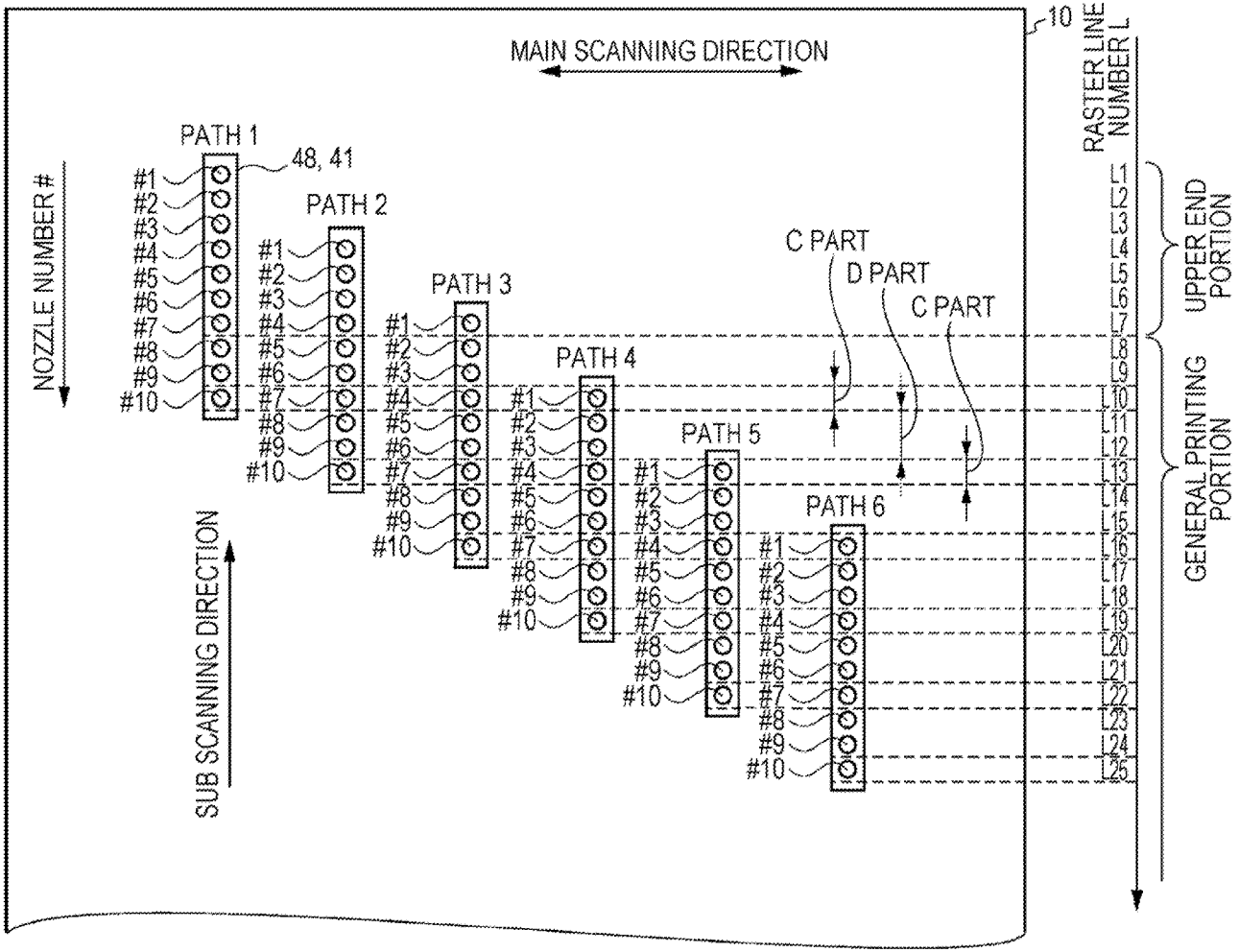

[Fig. 8A]
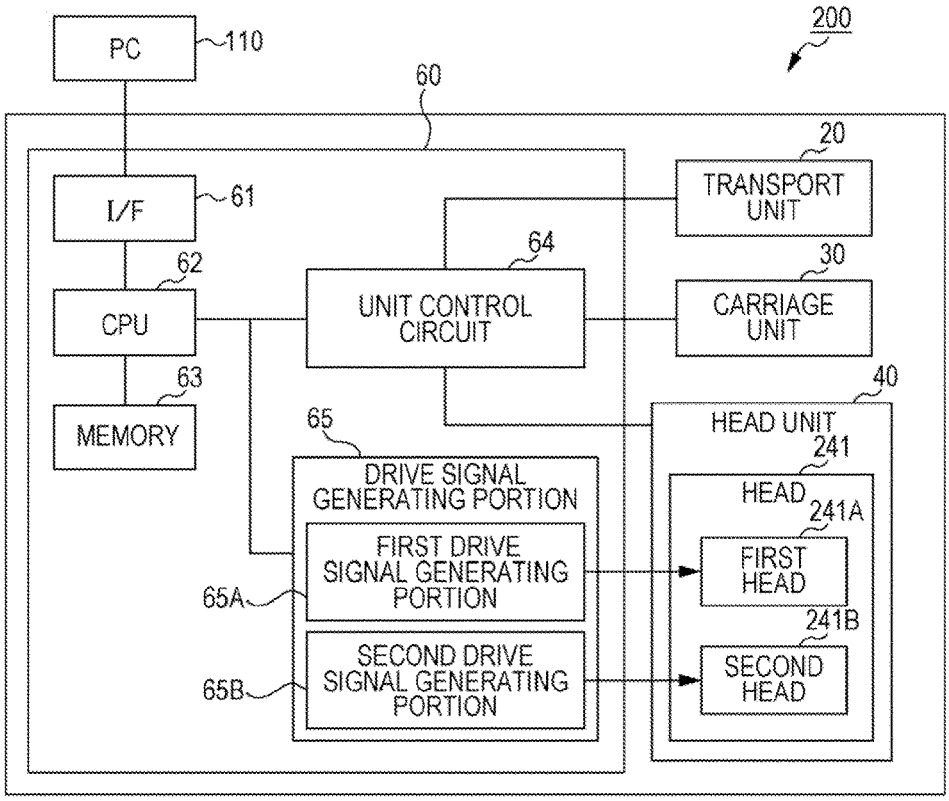
[Fig. 8B]
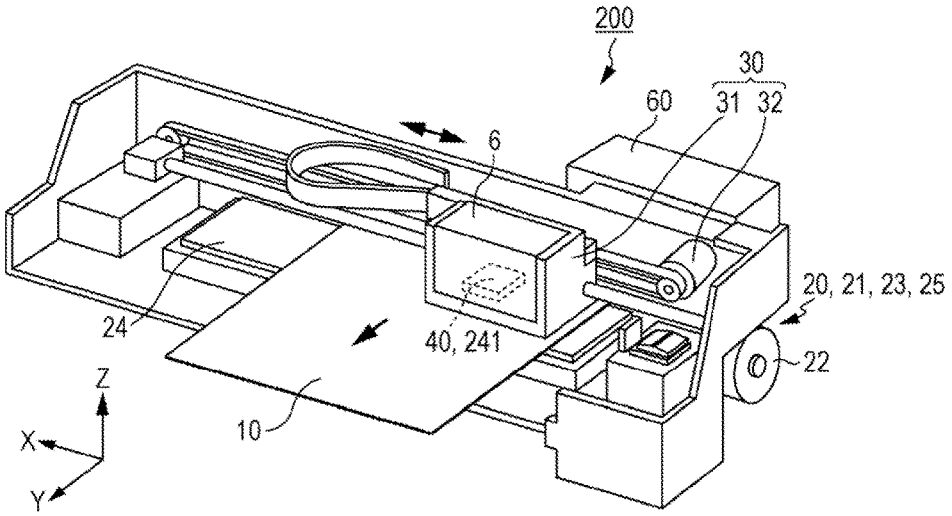

[Fig. 9]
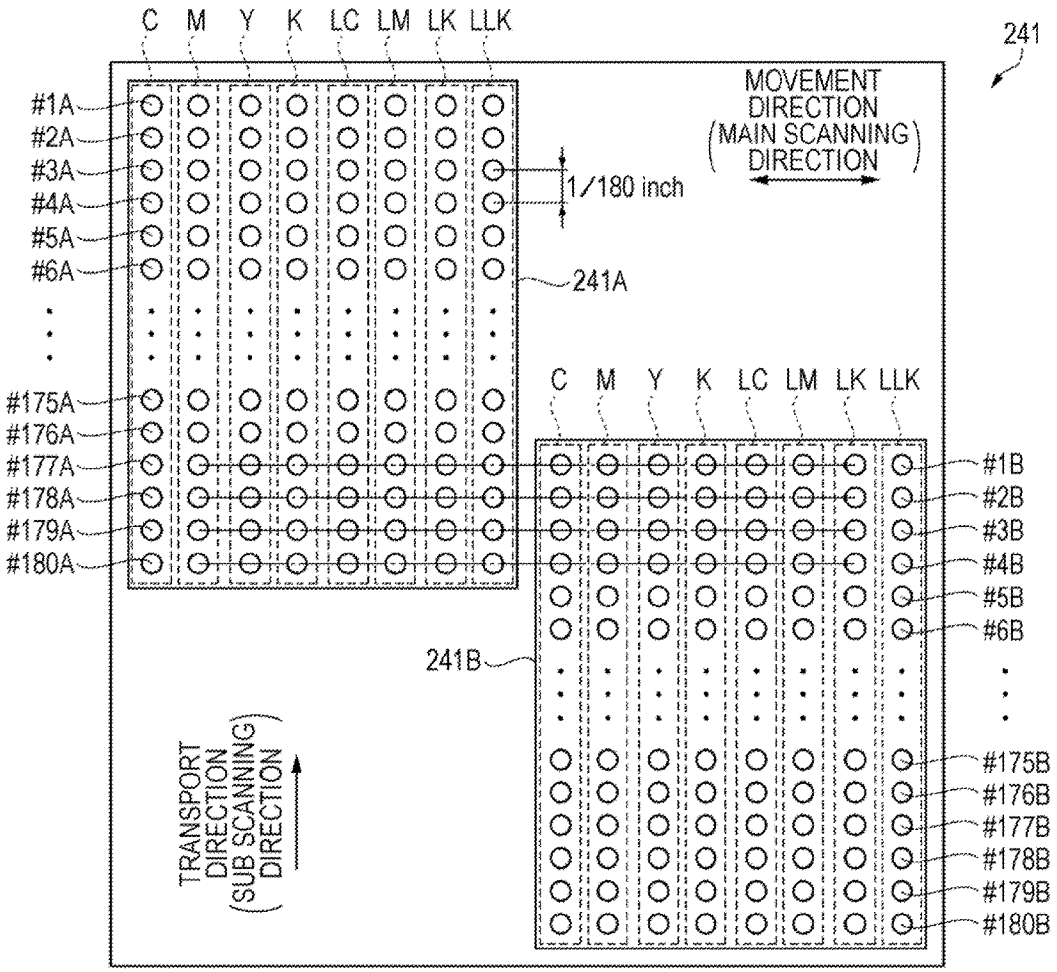

[Fig. 10]
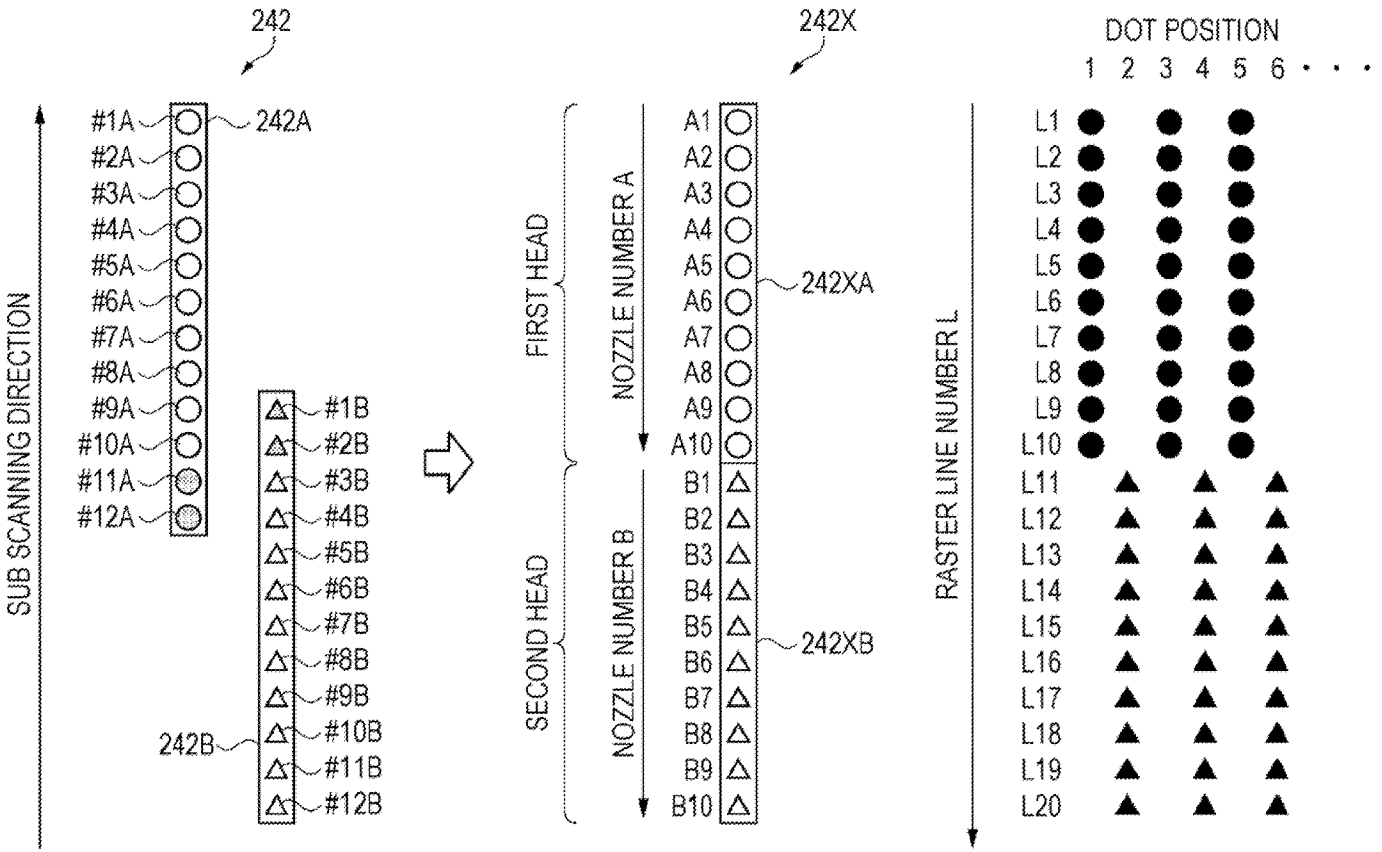

[Fig. 11]
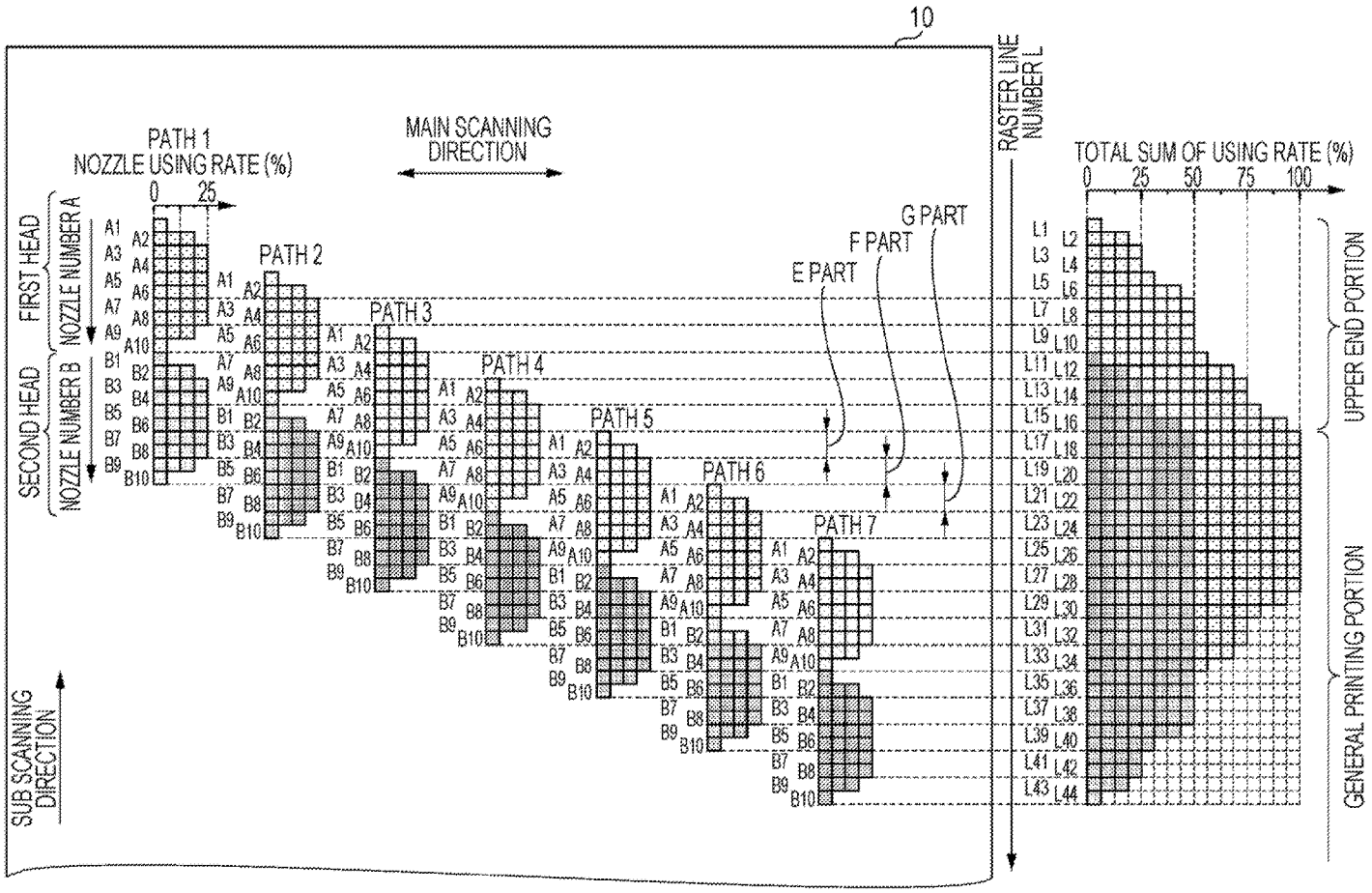

IMAGE FORMING APPARATUS AND IMAGE FORMING METHOD

CROSS REFERENCE TO RELATED APPLICATIONS

This application is a U.S. National Phase Application under 35 U.S.C. 371 of International Application No. PCT/JP2015/004669 filed on Sep. 14, 2015 and published in English as WO 2016/042752 A1 on Mar. 24, 2016. This application claims priority to Japanese Patent Application No. 2014-189733 filed Sep. 18, 2014. The entire disclosures of all of the above applications are incorporated herein by reference.

TECHNICAL FIELD

The present invention relates to an image forming apparatus and an image forming method.

BACKGROUND ART

In the related art, as an example of an image forming apparatus, an ink jet type printer, which performs recording (printing) of an image by discharging ink droplets onto various recording media such as paper or a film and then forming a plurality of dots on a recording medium, is known. The ink jet type printer, for example, alternately repeats a dot forming operation (a pass) for forming dot arrays (raster lines) which are arranged in a line in a main scanning direction of the recording medium by discharging ink droplets with respect to the recording medium from each nozzle while moving (scanning) a head in which a plurality of nozzles are formed in the main scanning direction, and a transport operation for moving (transporting) the recording medium in a sub scanning direction intersecting a main scanning direction. Due to this, dots are arranged in a line without gaps in the main scanning direction and the sub scanning direction of the recording medium, and thereby an image is formed on the recording medium.

In such an ink jet type printer, the quality of a recorded image is improved as the number of times of pass is increased. For this reason, JP-A-2010-17976 discloses an image forming method of dividing a printing area in accordance with an image recorded on the recording medium, and then changing the number of times of scanning for each printing area so as to print an image.

SUMMARY OF INVENTION

Technical Problem

In the image forming method disclosed in PTL 1, the recording medium is divided into a plurality of printing areas, and the number of times of the scanning for only an area in which banding is easily generated is increased. Here, generally, it is necessary to transport the medium based on an amount of transport in the printing area with a large number of times of the scanning, while the printing is performed by the head moving over the printing areas with different number of times of the scanning. In this way, since it is necessary to change the amount of transport in accordance with the number of passes, there is a problem in that a printing speed is deteriorated.

Solution to Problem

The present invention has been made to solve at least a part of the above-described problem, and can be realized as the following embodiments and application examples.

APPLICATION EXAMPLE 1

According to this application example, there is provided an image forming apparatus including: a head including a plurality of nozzles which discharge a liquid with respect to a medium; scan portion scanning the head in a main scanning direction; and transport portion transporting the medium in a sub scanning direction intersecting the main scanning direction, in which in the sub scanning direction, when an area in a range of a nozzle at an end portion of the head to a nozzle at a predetermined distance is set as a predetermined area, and the medium is transported in a certain amount by using the head, the scan portion, and the transport portion so as to form an image on the medium, the number of times of scanning for forming a dot array which is formed by using the nozzles included in the predetermined area is more than the number of times of the scanning for forming a dot array which does not use the nozzle in the predetermined area, and the number of times of the scanning for forming the dot array by using the nozzles included in the predetermined area is at least three times.

According to this Application Example, the image forming apparatus forms the image on the medium by alternately repeating scan portion scanning the head having nozzles which are arranged in the sub scanning direction in the main scanning direction and transport portion transporting the medium in the sub scanning direction. Specifically, in the image forming apparatus, the head is moved (the pass) in the main scanning direction while a liquid is discharged from the nozzle onto the medium, and a dot array (a raster line) which is formed along the scanning direction is printed on the medium by the transport portion. The raster line can be formed through multiple passes in the sub scanning direction by transporting the medium within a width, which is smaller than the width of the head in which nozzles are formed, by the transport portion in the sub scanning direction. The image is formed on the medium when the raster line is printed on the medium in the sub scanning direction.

In the sub scanning direction, when an area in a range of the nozzle at an end of the head to the nozzle at a predetermined distance is assumed to be a predetermined area, the image forming apparatus quantitatively transports the medium by transport portion, and the raster line which is formed by using the nozzles included in the predetermined area is formed through a plurality of times of scanning which is more than the number of times of the scanning performed on the raster line which is formed without using the nozzles in the predetermined area.

Due to a landing deviation of dots caused by a variation of the scan portion, the transport portion, and the like, the banding is easily recognized in a boundary portion between a first pass which causes the liquid to be discharged onto the medium, and a next pass which causes the liquid to be discharged onto the medium after transporting the medium in the sub scanning direction. That is, the banding is easily recognized in the raster line which is formed by using the nozzles included in the predetermined area of the head in the sub scanning direction. In this Application Example, the raster line which is formed by using the nozzles included in the predetermined area is formed by scanning more than the number of times of the scanning which is performed on the raster line which is formed without using the nozzle in the predetermined area. In addition, it is possible to quantitatively transport the medium in the sub scanning direction irrespective of image data, and thus the printing speed is not deteriorated.

APPLICATION EXAMPLE 2

In the image forming apparatus described in the above Application Example, it is preferable that the certain amount is the integer multiple of a predetermined distance.

According to this Application Example, it is possible to quantitatively transport the medium in the sub scanning direction irrespective of image data, and thus the printing speed is not deteriorated.

APPLICATION EXAMPLE 3

According to the image forming apparatus, it is preferable that in the sub scanning direction, in a case where an area in a range of a nozzle at one end to a nozzle at the predetermined distance is set as a first area, and an area in a range of a nozzle at the other end to a nozzle at a predetermined distance is set as a second area, and an area between the first area and the second area is set as a third area, an average nozzle using ratio of nozzles included in the first area is smaller than an average nozzle using ratio of nozzles included in the third area.

According to this Application Example, the head of the image forming apparatus is divided into three areas in the sub scanning direction; a first area which is a predetermined area in the range of a nozzle at an end portion on one end side of the head to a nozzle at a predetermined distance, a second area which is a predetermined area in the range of a nozzle at end portion on the other end side of the head to a nozzle at a predetermined distance, and a third area which is between the first area and the second area. When the raster line in which dots are arranged in a line in the main scanning direction is formed by discharging the liquid from a plurality of different nozzles through multiple passes, a ratio of the number of dots formed by one nozzle to the entire number of dots which form the raster line is referred to as a nozzle using ratio of the nozzle. In this Application Example, an average nozzle using ratio of nozzles included in the first area is smaller than an average nozzle using ratio of nozzles included in the third area. In other words, in the raster line which includes the nozzles in the first area and the nozzles in the third area, and which is formed through multiple passes, the number of dots formed by using the nozzles included in the first area on one end side of the head in which the bending is easily recognized is less than the number of dots formed by using the nozzles included in the third area, and thus the banding is not easily recognized any more.

APPLICATION EXAMPLE 4

According to the image forming apparatus, it is preferable that in an average nozzle using ratio of the nozzles which are included in the second area is smaller than an average nozzle using ratio of the nozzles which are included in the third area.

According to this Application Example, the average nozzle using ratio of the nozzles included in the second area is smaller than the average nozzle using ratio of nozzles included in the third area. In other words, in the raster line which includes the nozzles in the second area and the nozzles in the third area, and is formed through multiple passes, the number of dots formed by using the nozzles included in the second area on the other end side of the head in which the bending is easily recognized is less than the number of dots formed by using the nozzles included in the third area, and thus the banding is not easily recognized any more.

APPLICATION EXAMPLE 5

In the image forming apparatus described in the above Application Example, it is preferable that the average nozzle using ratio of the nozzles which form the raster line which does not use the nozzles included in the first area and the second area is greater than the average nozzle using ratio of the nozzles included in the first area, and is greater than the average nozzle using ratio of the nozzles included in the second area.

According to this Application Example, the average nozzle using ratio of the nozzles forming the raster line which does not use the nozzles included in the first area and the second area is greater than the average nozzle using ratio of the nozzles included in the first area, and is greater than the average nozzle using ratio of the nozzles included in the second area. In other words, in a single pass, the number of dots formed by using the nozzles which form the raster line which does not use the nozzles included in the first area and the second area is greater than the number of dots formed by using the nozzles in the first area, and is greater than the number of dots formed by using the nozzle in the second area, and thus the banding is not easily recognized any more.

APPLICATION EXAMPLE 6

It is preferable that the image forming apparatus described in the above Application Example is provided with a plurality of recording modes including a recording mode which performs image forming described in any one of Application Example 1 to Application Example 5.

According to this Application Example, in addition to a recording mode which realizes both of the image quality and the printing speed described in any one of Application Example 1 to Application Example 5, the image forming apparatus is provided with, for example, a recording mode attaching importance to image quality, and a recording mode attaching importance to printing speed, and thus it is possible to provide an image forming apparatus in response to various print requests from a user.

APPLICATION EXAMPLE 7

An image forming method of the image forming apparatus according to this Application Example includes, a scanning step of scanning a head having a plurality of nozzles in the main scanning direction and discharging a liquid to a medium, and a transport step of transporting the medium in the sub scanning direction intersecting the main scanning direction, in which in the sub scanning direction, when an area in a range of the nozzle at an end of the head to the nozzle at a predetermined distance is assumed to be a predetermined area, and the medium is transported in a certain amount through the scanning step and the transport step so as to form an image on the medium, the number of times of the scanning for forming a dot array which is formed by using the nozzle included in the predetermined area is more than the number of times of the scanning for forming a dot array which does not use the nozzle in the predetermined area.

According to this Application Example, the image forming method of the image forming apparatus is performed by forming an image on the medium by alternately repeating the scanning step of moving the head in the main scanning direction while discharging the liquid onto the medium from the nozzle and the transport step of transporting the medium in the sub scanning direction. Specifically, in the image forming method, a dot array (a raster line) which is formed along the main scanning direction is printed on the medium through the scanning step and the transport step. The raster line can be formed through several times of the scanning in the sub scanning direction by transporting the medium within a width, which is smaller than the width of the head in which nozzles are formed, through the transport step in the sub scanning direction. The image is formed on the medium in which the raster line is printed on the medium in the sub scanning direction.

In the sub scanning direction, when an area in a range of the nozzle at an end of the head to the nozzle at a predetermined distance is assumed to be a predetermined area, the image forming method is performed by forming the raster line which is formed by using the nozzles included in the predetermined area formed through a plurality of times of scanning which is more than the number of times of the scanning performed on the raster line which is formed without using the nozzle in the predetermined area.

Due to a landing deviation of dots caused by a variation of the scan portion, the transport portion, and the like, the banding is easily recognized in a boundary portion between a first scanning step of discharging the liquid onto the medium, and a next scanning step of discharging the liquid onto the medium after the transport step of transporting the medium in the sub scanning direction. That is, the banding is easily recognized in the raster line which is formed by using the nozzles included in the predetermined area of the head in the sub scanning direction. In this Application Example, the raster line which is formed by using the nozzles included in the predetermined area is formed through the scanning steps more than the number of times of the scanning step of the raster line which is formed without using the nozzle in the predetermined area. In addition, it is possible to quantitatively transport the medium in the sub scanning direction irrespective of image data, and thus the printing speed is not deteriorated.

BRIEF DESCRIPTION OF DRAWINGS

FIG. 1A is a block diagram illustrating an entire configuration of an ink jet printer as an image forming apparatus according to a first embodiment.

FIG. 1B is a perspective view of the entire configuration of the ink jet printer as the image forming apparatus according to the first embodiment.

FIG. 2 is an explanatory diagram illustrating an example of a nozzle array.

FIG. 3 is a sectional view illustrating an internal configuration of a head.

FIG. 4A is a diagram illustrating a using ratio of the nozzle array and a nozzle.

FIG. 4B is a diagram illustrating the using ratio of the nozzle array and the nozzle.

FIG. 5 is a diagram illustrating a method of forming a raster line formed through multiple passes.

FIG. 6A is an explanatory diagram of a case where movement averaging of a nozzle using ratio is indicated by linear approximation.

FIG. 6B is an explanatory diagram of the case where the movement averaging of the nozzle using ratio is indicated by the linear approximation.

FIG. 7 is a diagram illustrating a method of forming the raster line through multiple passes.

FIG. 8A is a block diagram illustrating an entire configuration of an ink jet printer as an image forming apparatus according to a second embodiment.

FIG. 8B is a perspective view of the entire configuration of the ink jet printer as the image forming apparatus according to the second embodiment.

FIG. 9 is an explanatory diagram illustrating an example of the nozzle array which is provided in a head.

FIG. 10 is an explanatory diagram of denoting a head set as a virtual head set.

FIG. 11 is a diagram illustrating a method of forming a raster line by using two heads through multiple passes.

DESCRIPTION OF EMBODIMENTS

Hereinafter, embodiments of the present invention will be described with the drawings. Further, in the following drawings, in order to make each layer and each member clearly understandable, there is a case of making the scale in each layer and each member different from that in the actual structure.

In addition, in FIG. 1A and FIG. 1B, FIG. 3, and FIG. 8A and FIG. 8B, for the sake of convenience of description, as three axes which are orthogonal to each other, an X-axis, a Y-axis, and a Z-axis are shown in the drawings, a tip end side and a base end side of an arrow indicating an axial direction are respectively assumed to be "+side" and "−side". In addition, hereinafter, a direction in parallel with the X-axis is referred to as an "X-axis direction" or a "main scanning direction", a direction in parallel with the Y-axis is referred to as a "Y-axis direction" or a "sub scanning direction" and a direction in parallel with the Z-axis is referred to as a "Z-axis direction"

First Embodiment

Image Forming Apparatus

FIG. 1A is a block diagram illustrating an entire configuration of an ink jet printer 100 as an image forming apparatus according to a first embodiment, and FIG. 1B is a perspective view illustrating the entire configuration of the ink jet printer as the image forming apparatus according to the first embodiment.

First, a basic configuration of the ink jet printer 100 will be described.

Basic Configuration of Ink Jet Printer

The ink jet printer 100 includes a transport unit 20 as transport portion, a carriage unit 30 as scan portion, a head unit 40, and a control unit 60. The ink jet printer 100 which receives printing data (image forming data) from a computer 110 which is an external device controls the respective units (the transport unit 20, the carriage unit 30, and the head unit 40) by the control unit 60. The control unit 60 controls the respective units based on the printing data from the computer 110 so as to print an image on the sheet 10 which is a medium.

The carriage unit 30 is scan portion scanning (moving) a head 41 in a predetermined movement direction (the X-axis direction illustrated in FIG. 1B, hereinafter, referred to as a main scanning direction). The carriage unit 30 includes a carriage 31, a carriage motor 32, and the like. The carriage 31 holds the head 41 including a plurality of nozzles 43 (refer to FIG. 2 and FIG. 3) which can discharge ink, as a liquid, with respect to the sheet 10 and an ink cartridge 6.

The ink cartridge 6 stores the ink discharged from the head 41, and is detachably attached with respect to the carriage 31. The carriage 31 is reciprocally movable in the scanning direction, and is driven by the carriage motor 32. Due to this, the head 41 is moved in the main scanning direction (±X-axis direction).

The transport unit 20 is transport portion transporting (moving) the sheet 10 in the sub scanning direction (a Y direction indicated in FIG. 1B) intersecting the main scanning direction. The transport unit 20 includes a paper feeding roller 21, a transport motor 22, a transport roller 23, a platen 24, a paper discharging roller 25, or the like. The paper feeding roller 21 is a roller for feeding the sheet 10 which is inserted into a paper insertion port (not shown) in the ink jet printer 100. The transport roller 23 is a roller transporting the sheet 10 which is fed by the paper feeding roller 21 to a printable area, and is driven by the transport motor 22. The platen 24 supports the sheet 10 in the middle of printing. The paper discharging roller 25 is a roller for discharging the sheet 10 to the outside of the printer, and is provided on the downstream side with respect to the printable area in the sub scanning direction.

The head unit 40 discharges ink as a liquid droplet (hereinafter, referred to as an ink droplet) onto the sheet 10. The head unit 40 is provided with the head 41 including a plurality of nozzles 43 (refer to FIG. 2). The head 41 is mounted on the carriage 31, and thus if the carriage 31 is moved in the scanning direction, the head 41 is also moved in the scanning direction. In addition, when the ink is discharged on the medium while the head 41 is moved in the scanning direction, a dot array (a raster line) is formed on the sheet 10 along the scanning direction.

The control unit 60 controls the ink jet printer 100. The control unit 60 includes an interface portion 61, a central processing unit (CPU) 62, a memory 63, a unit control circuit 64, and a drive signal generating portion 65. The interface portion 61 transmits and receives data between the computer 110, which is an external device, and the ink jet printer 100. The CPU 62 is an operation processing device for controlling the entire printer. The memory 63 secures an area which stores a program of the CPU 62, a working area, or the like, and includes a memory element such as a random access memory (RAM) and an electrically erasable programmable read-only memory (EEPROM).

The CPU 62 controls the respective units (the transport unit 20, the carriage unit 30, and the head unit 40) via the unit control circuit 64 in accordance with the program stored in the memory 63. The drive signal generating portion 65 generates a drive signal for driving a piezoelelectric element 45 (refer to FIG. 3) which causes the nozzle 43 to discharge ink.

At the time of printing, the control unit 60 moves the head 41 in the scanning direction by the carriage 31 as the scan portion while discharging the ink onto the sheet 10 as the medium from the nozzle 43. This operation is referred to as a "pass" or a "scanning step". Due to this, the dot array (the raster line) which is formed along the scanning direction is printed on the sheet 10. Next, the control unit 60 transports the sheet 10 in the sub scanning direction by the transport unit 20 as the transport portion. This operation is referred to as a "transport step". By repeatedly performing the scanning step and the transport step by the control unit 60, the raster lines are arranged on the sheet 10 in the sub scanning direction and an image is formed on the sheet 10. In the present embodiment, one raster line is formed through multiple passes by transporting the sheet 10 within a width, which is smaller than the width of the head 41 in the sub scanning direction. This is referred to as an n-th pass (n: integer) printing and the n-th pass is referred to as a "pass n".

Configuration of Head

FIG. 2 is an explanatory diagram illustrating an example of a nozzle array of the nozzle 43 included in the head 41. FIG. 3 is a sectional view illustrating an internal configuration of the head 41.

As illustrated in FIG. 2, eight nozzle arrays are provided in the head 41, and the nozzle plate 42 on which discharge ports of the nozzles 43 are opened is provided on the lower surface (a surface of −Z-axis side in FIG. 1A and FIG. 1B) of the head 41. Each of the eight nozzle arrays discharges ink of dark cyan (C), dark magenta (M), yellow (Y), dark black (K), light cyan (LC), light magenta (LM), light black (LK), and extremely light black (LLK).

In each of the nozzle arrays, for example, 180 nozzles (from nozzle #1 to nozzle #180) which are arranged in the sub scanning direction are provided at a nozzle pitch of 180 dpi (dots per inch). In FIG. 2, earlier node numbers #n (n=1 to 180) are attached to the nozzles 43 which are positioned on the downstream side in the sub scanning direction. Meanwhile, the number of the nozzle arrays and the types of ink are merely an example of the embodiment and are not limited thereto.

As illustrated in FIG. 3, the head 41 is provided with the nozzle plate 42, and the nozzle 43 is formed on the nozzle plate 42. A cavity 47 which communicates with the nozzle 43 is formed on a position which is the upper side (+Z-axis side) of the nozzle plated 42 and faces the nozzle 43.

In addition, ink which is stored in the ink cartridge 6 is supplied to the cavity 47 of the head 41.

A vibrating plate 44 which vibrates in the vertical direction (±Z-axis direction) so as to expand and reduce a capacity in the cavity 47, and the piezoelelectric element 45 as pressuring means for extending and contracting in the vertical direction to vibrate the vibrating plate 44 are provided on the upper side (+Z-axis side) of the cavity 47. When the piezoelelectric element 45 extends and contracts in the vertical direction so as to vibrate the vibrating plate 44, and the vibrating plate 44 expands and reduces the capacity in the cavity 47, the cavity 47 is pressured. Due to this, pressure in the cavity 47 is changed, and the ink supplied into the cavity 47 is discharged through the nozzle 43.

When the head 41 receives a drive signal for control-driving the piezoelelectric element 45 which is generated in the drive signal generating portion 65 (refer to FIG. 1A and FIG. 1B), the piezoelelectric element 45 extends, and the vibrating plate 44 reduces the capacity in the cavity 47. As a result, as the ink droplet 46, the ink corresponding to a reduced capacity is discharged from the nozzle 43 of the head 41. Meanwhile, in the present embodiment, the pressuring means is exemplified by using the piezoelelectric element 45 which is formed into a longitudinal vibration-type, but is not limited thereto. For example, a flexural deformation-type piezoelelectric element, which is formed by stacking a lower electrode, a piezoelectric layer, and an upper electrode, may be used. In addition, as the pressure generating means, a so called electrostatic actuator which causes static electricity between the vibrating plate and the electrode and causes the vibrating plate to be deformed by an electrostatic force so as to discharge the ink droplet from the nozzle may be used. Further, a head having a configuration in which foam is generated in the nozzle by using a heating element and ink as the ink droplet is discharged by using the generated foam may be employed.

Nozzle Array and Nozzle Using Ratio

FIG. 4A and FIG. 4B are diagrams illustrating a using ratio of the nozzle array and a nozzle. Before describing a forming method of the raster line, the nozzle array and the nozzle using ratio will be described with reference to FIG. 4A and FIG. 4B. Meanwhile, in the following description, for the sake of simplification of description, one nozzle array 48 in which 10 nozzles (from nozzle #1 to nozzle #10) are formed is provided in the head 41, and the printing is performed by using only one color of ink.

FIG. 4A illustrates a relationship between a position where the respective nozzles are provided and the area thereof. As illustrated in FIG. 4A, the nozzle array 48 is provided with 10 nozzles which are arranged along the sub scanning direction, and an area in a range of a nozzle at an end portion of the head 41 to a nozzle at a predetermined distance in the sub scanning direction is assumed to be a predetermined area. In the present embodiment, two nozzles (nozzle numbers #1, and #2) on the downstream side of the head 41 in the sub scanning direction and two nozzles (nozzle numbers #9, and #10) on the upstream side of the head 41 in the sub scanning direction are positioned in the predetermined area. The head 41 is divided into three areas, an area in a range of a nozzle at one end from a nozzle at a predetermined distance (a predetermined area on the downstream side in the sub scanning direction) is referred to as a first area, and an area in a range of a nozzle at the other end to a nozzle at a predetermined distance (a predetermined area on the upstream side in the sub scanning direction) is referred to as a second area, and an area in the range of the first area to the second area is referred to as a third area.

FIG. 4B is a diagram illustrating a ratio of ink droplets which are ejected from the nozzles in a single pass as a nozzle using ratio. As described above, through multiple passes, the dot array (the raster line) which is formed along the scanning direction is printed on the sheet 10. The nozzles (from nozzle #3 to nozzle #8) of which the nozzle using ratio is 50% discharge the ink droplets forming dots which are half of the entire number of dots forming one raster line in a single pass. For example, when one raster line is formed of 1000 dots, the nozzle #3 discharges the ink droplets for forming 500 dots in a single pass.

The average nozzle using ratio of the nozzles (nozzle #1 and nozzle #2) included in the first area is set to be smaller than the average nozzle using ratio of the nozzle (from nozzle #3 to nozzle #8) included in the third area. The average nozzle using ratio of the nozzles (nozzle #9 and nozzle #10) included in the second area is set to be smaller than the average nozzle using ratio of the nozzles (from the nozzle #3 to nozzle #8) included in the third area.

Specifically, the nozzle using ratio of the nozzle #1 is 12.5%, the nozzle using ratio of the nozzle #2 is 37.5%, and therefore, the average nozzle using ratio of the nozzles included in the first area becomes 25%.

In the same way, the nozzle using ratio of the nozzle #9 is 37.5%, the nozzle using ratio of the nozzle #10 is 12.5%, and therefore, the average nozzle using ratio of the nozzles included in the second area becomes 25%. The nozzle using ratio of each of the nozzle #3 to the nozzle #8 is 50%, and the average nozzle using ratio of the nozzles included in the third area is 50%. Accordingly, the average nozzle using ratio between the nozzle #1 and the nozzle #2 which are included in the first area is smaller than the average nozzle using ratio from the nozzle #3 to the nozzle #8 which are included in the third area, and the average nozzle using ratio between the nozzle #9 and the nozzle #10 which are included in the second area is smaller than the average nozzle using ratio from nozzle #3 to nozzle #8 which are included in the third area.

<Image Forming Method>

Next, an image forming method of the image forming apparatus will be described.

FIG. 5 is a diagram illustrating a method of forming the raster lines in multiple passes. In addition, in FIG. 5, the position of the head 41 (refer to FIG. 1A and FIG. 1B) is indicated by the nozzle numbers in FIG. 4A. FIG. 5 illustrates a relative position between the sheet 10 and the head 41 (nozzle numbers) in the sub scanning direction when the pass operation (the scanning step) for causing the head 41 to move to the main scanning direction from the upper end of the sheet 10 while causing the nozzles (from nozzle #1 to the nozzle #10) to discharge ink, and the transport operation (the transport step) for causing the transport unit 20 to transport a certain amount (the amount corresponding to four nozzles in the present embodiment) of sheet 10 in the sub scanning direction are repeated six times. That is, FIG. 5 illustrates that the nozzle (the head 41) moves with respect to the sheet 10, but the positional relationship between the nozzle (the head 41) and the sheet 10 may be relatively changed, the nozzle (the head 41) may be moved, the sheet 10 may b moved, and both the nozzle (the head 41) and the sheet 10 may be moved. In the present embodiment, an example of a case where the sheet 10 is transported in the sub scanning direction will be described. Since the notation for the position of the nozzle (the head 41) in an every single pass is obliquely shown in the scanning direction so as not to overlap, the positional relationship between the sheet 10 and the nozzle (the head 41) in the scanning direction cannot be realized.

The nozzle using ratio corresponding to each nozzle illustrated in FIG. 4A and FIG. 4B is indicated on the side of each nozzle number in every single pass. In addition, on the right side of the sheet 10, the total nozzle using ratio in the n-th pass with respect to the raster line which is formed in the n-th pass (n=2 or 3). From the nozzle using ratio corresponding to each pass and each nozzle, it is found that as for the raster line L7, dots which are 50% of the entire dot numbers forming the raster line L7 are formed by the nozzle #7 in the pass 1, and the remaining 50% of the dots are formed by the nozzle #3 in the pass 2, for example. An upper end portion including the raster lines L1 to L6 of which the total nozzle use ratio is less than 100% is subjected to an upper end treatment by minute feeding of the sheet 10, but since this upper end treatment is a well known technology, the description thereof will be omitted.

The raster line in A section of the general printing portion is formed by using at least one nozzle of the nozzles #1, #2, #9, and #10, which are included in a predetermined area (the first area and the second area illustrated in FIG. 4A), and three different nozzles through three passes (control by three nozzles). The raster line in B section is formed by two different nozzles through two passes (control by two nozzles) without using the nozzles #1, #2, #9, and #10 which are included in the predetermined area. That is, the number of times of the scanning for forming the raster line by using the nozzles #1, #2, #9, and #10 which are included in the predetermined area is at least three passes, and is more than the number of times of the scanning for forming the raster line without using the nozzles #1, #2, #9, and #10 which are included in the predetermined area.

Here, a partial overlap control is a method of dispersing dots which are formed by using the same nozzle, with respect to an area printed in a certain pass, and a method of printing in such a manner that a portion of the area overlaps in other passes. For example, one raster line is formed by using the plurality of nozzles through multiple passes.

In addition, the average nozzle using ratio of the nozzles (for example, nozzle #3 and nozzle #7) forming the raster line (for example, the raster line L11) without using the nozzles #1, #2, #9, and #10 which are included in the first area and the second area is greater than the average nozzle using ratio of the nozzles (nozzle #1 and nozzle #2) which are included in the first area, and is greater than the average nozzle using ratio of the nozzles (nozzle #9 and nozzle #10) which are included in the second area.

Next, a method of forming the raster line L7 to the raster line L16 which are the general printing portion will be described.

First, the sheet 10 is transported to a predetermined position in the transport step. Dots are formed in the raster line L1 to the raster line L10 in the scanning step of the pass 1. Here, the raster line L7 to the raster line L10 which are the general printing portion will be described. In the raster line L7, dots which are 50% of the entire dot numbers forming the raster line by the ink droplets discharged from the nozzle #7 are formed. In the same way, 50% of dots are formed by using the nozzle #8 in the raster line L8, 37.5% of dots are formed by using the nozzle #9 in the raster line L9, and 12.5% of dots are formed by using the nozzle #10 in the raster line L10.

Next, the sheet 10 is transported in the sub scanning direction by a distance corresponding to four nozzles in the transport step.

In the present embodiment, the sheet 10 is transported by a distance corresponding to four nozzles which are equivalent to integer multiple of the nozzles #1, and #2 which are included in the first area, or the nozzles #9, and #10 which are included in the second area. In other words, the sheet 10 is transported by the distance of integer multiple of a predetermined distance from one end to the other end of the plurality of nozzles which are included in a predetermined area in the sub scanning direction. Dots are formed from the raster line L5 to the raster line L14 in the scanning step of the pass 2. Here, the raster line L7 to the raster line L14 which are the general printing portion will be described. In the raster line L7, the remaining 50% of the dots of the entire dot numbers forming the raster line by the ink droplets discharged from the nozzle #3 are formed. In the same way, in the raster line L8, the remaining 50% of the dots are formed by the nozzle #4. In the raster line L7 and the raster line L8, the entire dots (100%) are formed on the raster line through the pass 1 and the pass 2.

In the raster line L9, 50% of dots are formed by using the nozzle #5 and are added to the dots formed in the pass 1, thereby forming 87.5% of dots. In the raster line L10, 50% of dots are formed by using the nozzle #6 and are added to the dots formed in the pass 1, thereby forming 62.5% of dots.

Dots which are 50% of the entire dot numbers forming the raster line by using the nozzle #7 are formed in the raster line L11. In the same way, 50% of dots are formed by using the nozzle #8 in the raster line L12, 37.5% of dots are formed by using the nozzle #9 in the raster line L13, and 12.5% of dots are formed by using the nozzle #10 in the raster line L14.

Next, the sheet 10 is transported in the sub scanning direction by a distance corresponding to four nozzles in the transport step.

Dots are formed from the raster line L9 to the raster line L18 in the scanning step of the pass 3. Here, the description will be described to the raster line L16. In the raster line L9, the remaining 12.5% of the dots of the entire dot numbers forming the raster line by the ink droplets discharged from the nozzle #1 are formed. In the same way, in the raster line L10, the remaining 37.5% of the dots are formed by the nozzle #2. Due to this, in the raster line L9 and the raster line L10, the entire dots (100%) are formed on the raster line through the pass 1 to the pass 3.

In the raster line L11, the remaining 50% of the dots of the entire dot numbers forming the raster line by the ink droplets discharged from the nozzle #3 are formed. In the same way, in the raster line L12, the remaining 50% of the dots are formed by the nozzle #4. Due to this, in the raster line L11 and the raster line L12, the entire dots (100%) are formed on the raster line through the pass 2 and the pass 3.

In the raster line L13, 50% of dots are formed by using the nozzle #5 and are added to the dots formed in the pass 2, thereby forming 87.5% of dots. In the raster line L14, 50% of dots are formed by using the nozzle #6 and are added to the dots formed in the pass 2, thereby forming 62.5% of dots.

Dots which are 50% of the entire dot numbers forming the raster line by using the nozzle #7 are formed in the raster line L15. In the same way, 50% of dots are formed by using the nozzle #8 in the raster line L16.

Next, the sheet 10 is transported in the sub scanning direction by a distance corresponding to four nozzles in the transport step.

Dots are formed from the raster line L13 to the raster line L22 in the scanning step of the pass 4. Here, the description will be described to the raster line L16. In the raster line L13, the remaining 12.5% of the dots of the entire dot numbers forming the raster line by the ink droplets discharged from the nozzle #1 are formed. In the same way, in the raster line L14, the remaining 37.5% of the dots are formed by the nozzle #2. Due to this, in the raster line L13 and the raster line L14, the entire dots (100%) are formed on the raster line through the pass 2 to the pass 4.

In the raster line L15, the remaining 50% of the dots of the entire dot numbers forming the raster line by the ink droplets discharged from the nozzle #3 are formed. In the same way, in the raster line L16, the remaining 50% of the dots are formed by the nozzle #4. Due to this, in the raster line L15 and the raster line L16, the entire dots (100%) are formed on the raster line through the pass 3 and the pass 4. Herein below, by repeating the scanning step and the transport step, the raster lines in which the entire dots are formed are arranged in the sub scanning direction, and the image is formed on the sheet 10.

According to this image forming method, the number of times of the scanning required for forming the raster line by using at least one nozzle in the nozzles #1, #2, #9, and #10 which are included in a predetermined area (the first area and the second area) becomes greater than the number of times of the scanning required for forming the raster line which does not use the nozzles #1, #2, #9, and #10 which are included in a predetermined area.

Specifically, for example, the raster line L9 is formed by using the nozzle #9 included in the second area in the pass 1, the nozzle #5 included in the third area in the pass 2, and the nozzle #1 included in the first area in the pass 3. That is, the raster line which uses at least one nozzle of the nozzles #1, #2, #9, and #10 which are included in a predetermined area (the first area and the second area) is formed through three passes (control by three nozzles).

For example, the raster line L8 is formed by using the nozzle #8 included in the third area in the pass 1, and the nozzle #4 included in the third area in the pass 2. That is, the raster line which does not use the nozzles #1, #2, #9, and #10 which are included in a predetermined area (the first area and the second area) is formed through two passes (control by two nozzles).

A banding (a horizontal stripe) is easily recognized at the boundary portion between printing through the previously performed pass, and the printing through the after performed pass, in the sub scanning direction. That is, the banding is easily recognized in the raster line which is formed by using at least one nozzle of the nozzles #1, #2, #9, and #10 which are included in a predetermined area. In the present embodiment, the number of times of the scanning for forming the raster line which uses at least one nozzle of the nozzles #1, #2, #9, and #10 which are included in a predetermined area is greater than the number of times of the scanning for forming the raster line which does not use the nozzles #1, #2, #9, and #10 which are included in a predetermined area, and thus the banding is not easily recognized.

In addition, the raster line L9 is positioned at a boundary portion between printing through the previously performed pass (the pass 1 and the pass 2), and the printing through the after performed pass (the pass 3), and the banding is easily recognized between the raster line L8 and the raster line L9. In the present embodiment, in the raster line L9 which is formed by controlling three nozzles, dots which are 37.5% of the entire dot numbers forming the raster line by using the nozzle #9 in the pass 1. In the same way, 50% of dots are formed by using the nozzle #5 in the pass 2, and 12.5% of dots are formed by using the nozzle #1 in the pass 3. In the pass 3, even in a case where the banding is generated due to transport deviation of the sheet 10, the number of dots formed in the pass 3 is 12.5% of the entire dot numbers forming the raster line L9, and thus the banding is not easily recognized.

The image forming apparatus (the ink jet printer 100) in the present embodiment is provided with a plurality of recording modes including a recording mode which realizes the printing speed and the quality of the image. For example, a recording mode in which image quality is prioritized, a recording mode in which a printing speed is prioritized, and a recording mode which reduces consumption of ink are provided, and thus it is possible to in response to various print requests from a user.

Note that, the nozzle using ratio is not intended to be limited to the ratio described in the present embodiment.

FIG. 6A and FIG. 6B are explanatory diagrams of a case where movement averaging of a nozzle using ratio is indicated by linear approximation.

In the diagram of the nozzle using ratio illustrated in FIG. 4B, the number of nozzles is set to be 10, and thus the nozzles are formed into a stepwise shape, but in a case where the number of nozzles is set to be n (for example n=180), FIG. 4B can represent a moving average of the nozzle using ratio by a trapezoidal shape connecting straight lines to each other as illustrated in FIG. 6A.

FIG. 6B is a diagram illustrating another example of the nozzle using ratio. As illustrated in FIG. 6B, the third area is further divided into three areas, and it is assumed that the center area is a center section, an area between the center section and the first area is a first middle section, and an area between the center section and the second area is a second middle section. The average nozzle using ratio of the nozzles positioned in the first middle section is greater than the average nozzle using ratio of the nozzles positioned in the first area, and is smaller than the average nozzle using ratio of the nozzles positioned in the center section. The average nozzle using ratio of the nozzles positioned in the second middle section is greater than the average nozzle using ratio of the nozzles positioned in the second area, and is smaller than the average nozzle using ratio of the nozzles positioned in the center section.

In this way, an amount of variation in the moving average of the nozzle using ratio (inclination) within the first area and the second area becomes gentle by providing the first middle section and the second middle section, and thus by using the nozzle using ratio as illustrated in FIG. 6B, the banding (density unevenness) generated due to a landing deviation of ink droplets in the scanning direction is not easily recognized on the image formed by the image forming method. Note that, the nozzle using ratio illustrated in FIG. 4B is merely an example, and is not limited to the example. The area indicating the position of the nozzle may be further subdivided, or each nozzle using ratio may be changed in a curved shape.

In addition, in the present embodiment, the raster line is formed through two passes or three passes, but is not limited thereto.

FIG. 7 is a diagram illustrating a method of forming the raster line through the multiple pass (four passes or three passes). In FIG. 7, the position of the head 41 (refer to FIG. 1A and FIG. 1B) is indicated by the nozzle number illustrated in FIG. 4A. FIG. 5 illustrates a relative position between the sheet 10 and the head 41 (nozzle numbers) in the sub scanning direction when the pass operation (the scanning step) for causing the head 41 to move to the main scanning direction from the upper end of the sheet 10 while causing the nozzles (from nozzle #1 to the nozzle #10) to discharge ink, and the transport operation (the transport step) for causing the transport unit 20 to transport the amount corresponding to three nozzles (transport step) of the sheet 10 in the sub scanning direction are repeated six times.

In the head 41 in the image forming method in FIG. 7, the nozzle #1 is included in the first area (a predetermined area), the nozzle #10 is included in the second area (a predetermined area), and nozzles from the nozzle #2 to the nozzle #9 are included in the third area. In addition, the nozzle using ratio of each nozzle is set such that the nozzle #1 and nozzle #10 are 16.7% and the nozzles from the nozzle #2 to the nozzle #9 are 33.3%.

As illustrated in FIG. 7, by repeatedly performing the transport step of transporting the sheet 10 by the distance corresponding to three nozzles in the sub scanning direction, and the scanning step, in the general printing portion after the raster line L8, the raster line of which the nozzle using ratio is 100% is formed. Note that, the upper end portion including the raster line L1 from the raster line L7 of which the total nozzle using ratio is less than 100% is subjected to the upper end treatment by minute feeding of the sheet 10.

The raster line in C section of the general printing portion is formed by using the nozzles #1, and #10, which are included in a predetermined area, and four different nozzles through four passes (control by four nozzles). The raster line in D section is formed by three different nozzles through three passes (control by three nozzles) without using the nozzles #1, and #10 which are included in the predetermined area. That is, the number of times of the scanning for forming the raster line by using the nozzles #1, and #10 which are included in the predetermined area is four passes (at least three passes), and is more than the number of times of the scanning for forming the raster line without using the nozzles #1, and #10 which are included in the predetermined area. In the way, the number of times of the scanning for forming the raster line may be increased by changing the transport distance in the transport step (the number of nozzles) and the nozzle using ratio of each nozzle. With this, it is possible to further improve the image quality.

As described above, according to the image forming apparatus (the ink jet printer 100) in the present embodiment, it is possible to achieve the following effect.

The ink jet printer 100 forms the raster line along the scanning direction through multiple passes by alternately repeating the pass operation (the scanning step) for causing the scan portion to quantitatively move the head 41 to the main scanning direction from the nozzle to the sheet 10 while causing the nozzles to discharge ink on the sheet 10 and the transport portion (the transport step) in the sub scanning direction.

The raster line which is formed by using the nozzles #1, #2, #9, and #10 which are included in a predetermined area of the head 41 is formed through three passes, and the raster line which does not use the nozzles #1, #2, #9, and #10 which are included in the predetermined area is formed through two passes. The banding (the horizontal stripe) is easily recognized in the raster line which is formed by using the nozzles #1, #2, #9, and #10 included in the predetermined area of the head 41, but since the number of times of the scanning for forming the raster line which is formed by using the nozzles #1, #2, #9, and #10 which are included in the predetermined area is more than the number of times of the scanning for forming the raster line which is formed by using the nozzles #1, #2, #9, and #10 which are included in the predetermined area, it is possible to improve the image quality. In addition, since the sheet 10 is transported in quantitative, the printing speed is not deteriorated due to the number of times of the scanning which is differentiated in the image. Accordingly, it is possible to provide the image forming apparatus (the ink jet printer 100) and the image forming method which achieve both of the improvement of the image quality and the improvement of the printing speed.

In addition, the average nozzle using ratio of the nozzles #1, #2, #9, and #10 which are included in the first area and the second area on both end sides of the head 41 is smaller than the average nozzle using ratio from nozzle #3 to nozzle #8 which are included in the third area between the first area and the second area. In addition, in a single pass, the number of dots formed by using the nozzles #3, #4, #7, and #8 which form the raster line which does not use the nozzles #1, #2, #9, and #10 which are included in the first area and the second area is more than the number of dots formed by using the nozzles included in the first area and the second area. When the raster line is formed through multiple passes, the number of dots formed by using the nozzles #1, #2, #9, and #10 which are included in the first area and the second area which are both end portions of the head 41 in which the bending is easily recognized is less than the number of dots formed by using the nozzles #3 to the nozzle #8 which are included in the third area, and thus the banding is not easily recognized.

The ink jet printer 100 is provided with the plurality of recording modes including a recording mode which realizes the printing speed and the quality of the image; the recording mode in which image quality is prioritized, the recording mode in which the printing speed is prioritized, and the recording mode which reduces consumption of ink are provided, and thus it is possible to in response to various print requests from a user.

Second Embodiment

A configuration of an ink jet printer 200 as the image forming apparatus according to the second embodiment is the same as that of the ink jet printer 100 according to the first embodiment except that the ink jet printer 200 includes two heads.

FIG. 8A is a block diagram illustrating an entire configuration of an ink jet printer as an image forming apparatus according to the second embodiment, and FIG. 8B is a perspective view illustrating the entire configuration of the ink jet printer as the image forming apparatus according to the second embodiment. FIG. 9 is an explanatory diagram illustrating an example of a nozzle array. FIG. 10 is an explanatory diagram of denoting a head set as a virtual head set. FIG. 11 is a diagram illustrating a method of forming a raster line.

The image forming apparatus according to the present embodiment will be described with reference to the drawings. Note that, the same constituent element as in the first embodiment is given the same reference numeral, and repeated description will be omitted.

First, a schematic configuration of the ink jet printer 200 as the image forming apparatus will be described.

The head unit 40 is provided with a head 241 including a plurality of nozzles. Since this head 241 is mounted on the carriage 31, when the carriage 31 is moved in the scanning direction, the head 241 is also moved in the scanning direction. In addition, if the head 241 discharges ink onto the sheet 10 while moving in the scanning direction, a dot line (a raster line) along the scanning direction is formed on the sheet 10. The head 241 is provided with a first nozzle group 241A as a first head and a second nozzle group 241B as a second head.

The control unit 60 is provided with the drive signal generating portion 65. The drive signal generating portion 65 is provided with a first drive signal generating portion 65A and a second drive signal generating portion 65B. The first drive signal generating portion 65A generates a drive signal for driving the piezoelelectric element 45 (refer to FIG. 3) which causes the first nozzle group 241A as the first head to discharge ink. The second drive signal generating portion 65B generates a drive signal for driving the piezoelelectric element 45 which causes the second nozzle group 241B as the second head to discharge ink.

Nozzle Array and Head Set

FIG. 9 is an explanatory diagram illustrating an example of a nozzle array which is provided in the head 241. The head 241 is provided with the first nozzle group 241A as the first head, and the second nozzle group 241B as the second head. In each nozzle group, eight nozzle arrays are provided, and discharge ports of these nozzles are opened to the lower surface (a surface in the −Z-axis direction in FIG. 8A and FIG. 8B) of the head 241.

The first nozzle group 241A is provided on the downstream side from the second nozzle group 241B in the sub scanning direction. In addition, the first nozzle group 241A and the second nozzle group 241B are provided in such a manner that positions of four nozzles are overlapped with each other in the sub scanning direction. For example, in the sub scanning direction, the position of the nozzle #177A in the first nozzle group 241A is set to be the same as the position of the nozzle #1B in the second nozzle group 241B. In addition, a combination of the nozzle arrays discharging the same ink (the ink formed by the same composition) between the first nozzle group 241A and the second nozzle group 241B is referred to as a "head set".

FIG. 10 is an explanatory diagram of denoting the head set as a virtual head set. Meanwhile, in the following description, for the sake of simplification of description, the head set obtained by combining a nozzle array 242A which is formed of 12 nozzles (from nozzle #1A to nozzle #12A), as the first head, and a nozzle array 242B which is formed of 12 nozzles (from nozzle #1B to nozzle #12B), as the second head is provided, and the printing is performed by using only one color of ink.

Four nozzles (from nozzle #9A to nozzle #12A) in the nozzle array 242A on the upstream side in the sub scanning direction and four nozzles (from nozzle #1B to nozzle #4B) in nozzle array 242B on downstream side in the sub scanning direction are overlapped with each other in the sub scanning direction. In the following description, these four nozzles in each nozzle array are referred to as overlapping nozzles.

Each nozzle in the nozzle array 242A is indicated by a circle, and each nozzle in the nozzle array 242B is indicated by a triangle. In addition, nozzles (that is, the nozzles which do not form dots) which do not discharge ink are hatched.

Here, among the overlapping nozzles in nozzle array 242A, ink is discharged from the nozzle #9A and the nozzle #10A, and is not discharged from the nozzle #11A and the nozzle #12A. In addition, among the overlapping nozzles in the nozzle array 242B, ink is not discharged from the nozzle #1B and the nozzle #2B, but is discharged from the nozzle #3B and the nozzle #4B.

In such a case, as described in the center section in FIG. 10, two heads of a nozzle array 242XA, as the first head, in which the nozzles which do not discharge ink are removed, and a nozzle array 242XB as the second head can be described as one virtual head set 242X. In the following description, a state of forming dots will be described by using the one virtual head set 242X instead of separately describing the two heads. In addition, nozzle numbers from A1 to A10 are newly attached to the nozzles in the nozzle array 242XA as the first head of the head set 242X, and nozzle numbers from B1 to B10 are newly attached to the nozzles in the nozzle array 242XB as the second head of the head set 242X.

The right side of FIG. 10 illustrates a dot position formed in the nozzle array 242XA as the first head, and the nozzle array 242XB as the second head. In the ink jet printer 200 of the embodiment, the nozzle array 242XA forms dots at an odd dot position in each of the raster lines in the scanning direction, and the nozzle array 242XB of the second head forms dots at an even dot position in each of the raster lines in the scanning direction. Note that, dots may be formed at the even dot position in the nozzle array 242XA of the first head and may be formed at the odd dot position in the nozzle array 242XB of the second head.

<Image Forming Method>

FIG. 11 is a diagram illustrating a method of forming the raster line by using two heads through multiple passes. In addition, in FIG. 11, the position of the head set 242X (refer to FIG. 10) is indicated by the nozzle numbers in FIG. 10. FIG. 11 illustrates a relative position between the sheet 10 and the nozzle (the nozzle number) provided in the sheet 10 and the head set 242X in the sub scanning direction when the pass operation (the scanning step) for causing the head set 242X to move to the main scanning direction from the upper end of the sheet 10 while causing the nozzles (from nozzle A1 to the nozzle B10) to discharge ink, and the transport operation (the transport step) for causing the transport unit 20 to transport the amount corresponding to four nozzles in the sub scanning direction are repeated seven times. That is, FIG. 11 illustrates that the nozzle (the head set 242X) moves with respect to the sheet 10, but the positional relationship between the nozzle (the head set 242X) and the sheet 10 may be relatively changed, the nozzle (the head set 242X) may be moved, the sheet 10 may be moved, and both the nozzle (the head set 242X) and the sheet 10 may be moved. In the present embodiment, an example of a case where the sheet 10 is transported in the sub scanning direction will be described. Since the notation for the position of the nozzle (the head set 242X) in an every single pass is obliquely shown in the scanning direction so as not to overlap, the positional relationship between the sheet 10 and the nozzle (the head set 242X) in the scanning direction cannot be realized.

The nozzle using ratio corresponding to each nozzle is indicated on the side of each nozzle number in every single pass. Meanwhile, in the nozzle array 242XA as the first head and the nozzle array 242XB as the second head, as indicated in FIG. 4A and FIG. 4B of the first embodiment, 10 nozzles are divided into three areas corresponding to a first area (a predetermined area), a second area (a predetermined area), and a third area. The first head forms dots (refer to FIG. 10) at the odd dot position in the raster line in the n-th pass (n=2 or 3), and the second head forms dots (refer to FIG. 10) at the even dot position in the raster line in the n-th pass (n=2 or 3). In other words, since the first head and the second head are independently controlled, the first head forms the raster line only with dots at the odd dot position, and the second head forms the raster line only with dots at the even dot position. Therefore, the nozzle using ratio of the first head and the second head is half of the case of one head as illustrated in FIG. 4A and FIG. 4B. Meanwhile, in the following description, the raster line which is formed of dots only at the odd dot position in the first head is referred to as an odd-numbered raster line, and the raster line which is formed of dots only at the even dot position in the second head is referred to as an even-numbered raster line.

As illustrated in FIG. 11, by repeatedly performing the transport step of transporting the sheet 10 by the distance corresponding to four nozzles in the sub scanning direction, and the scanning step, in the general printing portion after the raster line L17, the raster line of which the nozzle using ratio is 100% is formed. Note that, an upper end portion including the raster lines L1 to L16 of which the total nozzle use ratio is less than 100% is subjected to an upper end treatment by minute feeding of the sheet 10, but since this upper end treatment is a well known technology, the description thereof will be omitted.

Forming of the odd-numbered raster line by the first head will be described.

The odd-numbered raster line in E portion of the general printing portion is formed by using at least one of the nozzles A1, A2, A9, and A10 included in the predetermined area of the first head, and three different nozzles in the first head through three passes (control by three nozzles in the first head). The odd-numbered raster line in F portion of the general printing portion is formed by using two different nozzles in the first head through two passes (control by two nozzles in the first head) without using the nozzles A1, A2, A9, and A10 included in the predetermined area of the first head. That is, the number of times of the scanning for forming the odd-numbered raster line by using at least one of the nozzles A1, A2, A9, and A10 which are included in the predetermined area of the first head is at least three passes, and is more than the number of times of the scanning for forming the odd-numbered raster line without using the nozzles A1, A2, A9, and A10 which are included in the predetermined area of the first head.

Forming of the even-numbered raster line by the second head will be described.

The even-numbered raster line in F portion of the general printing portion is formed by using at least one of the nozzles B1, B2, B9, and B10 included in the predetermined area of the second head, and three different nozzles in the second head through three passes (control by three nozzles in the second head). The even-numbered raster line in E portion of the general printing portion is formed by using two different nozzles in the second head through two passes (control by two nozzles in the second head) without using the nozzles B1, B2, B9, and B10 included in the predetermined area of the second head. That is, the number of times of the scanning for forming the even-numbered raster line by using at least one of the nozzles B1, B2, B9, and B10 which are included in the predetermined area of the second head is at least three passes, and is more than the number of times of the scanning for forming the even-numbered raster line without using the nozzles B1, B2, B9, and B10 which are included in the predetermined area of the second head.

The raster line L21 included in G section will be described in detail.

The raster line L21 is positioned at a boundary portion between printing through the previously performed pass (from the pass 2 to the pass 5), and the printing through the after performed pass (the pass 6), and the banding is easily recognized between the raster line L20 and the raster line L21. In the present embodiment, the raster line L21 is formed of the even-numbered raster line which is formed by controlling two nozzles in the second head, and the odd-numbered raster line which is formed by controlling three nozzles in the first head.

Specifically, in the even-numbered raster line of the raster line L21, dots which are 25% of the entire dot numbers forming the raster line by using the nozzle B7 in the second head in the pass 2. In the same way, 25% of dots are formed by using the nozzle B3 in the pass 3.

In the odd-numbered raster line of the raster line L21, dots which are 18.75% of the entire dot numbers forming the raster line by using the nozzle A9 in the first head in the pass 4. In the same way, 25% of dots are formed by using the nozzle A5 in the pass 5, and 6.25% of dots are formed by using the nozzle Al in the pass 6.

In the pass 6, even in a case where the banding is generated due to transport deviation of the sheet 10, the number of dots formed in the pass 6 is 6.25% of the entire dot numbers forming the raster line L21, and thus the banding is not easily recognized. In addition, the ink jet printer 200 which is provided with two heads can perform printing at twice the speed of the image forming apparatus which is provided with one head in a case where an image is printed with the same image quality.

As described above, the image forming apparatus according to the embodiment (an ink jet printer 200) can obtain the following effects.

The ink jet printer 200 is provided with two heads of the first nozzle group 241A as the first head and the second nozzle group 241B as the second head, and thus it is possible to further improve the printing quality and the printing speed.

The invention claimed is:

1. An image forming apparatus comprising:

a head including a plurality of nozzles which discharge a liquid with respect to a medium, the plurality of nozzles being arranged along a first direction, the plurality of nozzles being mutually exclusively divided into at least a first group and a second group, the first group being located directly adjacent to a first nozzle edge of the plurality of nozzles in the first direction, the second group including a center area of the plurality of nozzles in the first direction;

a scan mechanism configured to scan the head along a main scanning direction perpendicular to the first direction;

a medium transport mechanism configured to transport the medium in a sub scanning direction parallel to the first direction;

a memory configured to store computer-readable instructions; and a processor configured to execute the computer-readable instructions so as to:

cause the scan mechanism to scan the head so that the head reciprocally moves along the main scanning direction while the processor causes the medium transport mechanism to periodically transport the medium in the sub scanning direction by the same distance so that an image is formed on the medium by the discharged liquid, the image being configured with a first region formed by a first recording and a second region formed by a second recording, the first and second regions being alternately arranged, wherein the processor is configured to cause the head to eject the liquid from the first and second groups of the plurality of nozzles in the first recording, the processor is configured to cause the head to eject the liquid from only the second group of the plurality of nozzles in the second recording, and a first number of scan passes of the head in the first recording is larger than a second number of scan passes of the head in the second recording.

2. The image forming apparatus according to claim 1, wherein a length of the first group of the plurality of nozzles along the first direction is a first distance, the processor is configured to transport the medium a second distance after the head completes one pass along the main scanning direction, and the second distance is at least two times the first distance.

3. The image forming apparatus according to claim 1, wherein the plurality of nozzles are mutually exclusively divided into the first and second groups and a third group, the third group is located directly adjacent to a second nozzle edge opposite to the first nozzle edge or the plurality of nozzles in the first direction, the second group is sandwiched between the first group and the third group, and a first average nozzle use ratio of the plurality of nozzles in the first group is smaller than a second average nozzle use ratio of the plurality of nozzles in the second group.

4. The image forming apparatus according to claim 3, wherein a third average nozzle use ratio of the plurality of nozzles in the third group is smaller than the second average nozzle use ratio.

* * * * *